US005552870A

United States Patent [19]

Murakami et al.

[11] Patent Number: 5,552,870

[45] Date of Patent: Sep. 3, 1996

[54] DEVELOPING DEVICE FOR AN IMAGE FORMING APPARATUS

[75] Inventors: Eisaku Murakami, Hiratsuka; Kazuhiro Yuasa, Zama; Shuichi Endoh, Isehara; Iwao Matsumae, Tokyo; Yoshiaki Tanaka, Kawasaki; Hiroshi Hosokawa, Yokohama; Mugijiroh Uno, Isehara; Hiroshi Saitoh, Ayase; Eiji Takenaka, Isehara; Toshihiro Sugiyama, Atsugi; Tetsuo Yamanaka, Tokyo; Satoru Komatsubara, Atsugi, all of Japan

[73] Assignee: Ricoh Company, Ltd., Tokyo, Japan

[21] Appl. No.: 365,080

[22] Filed: Dec. 28, 1994

[30] Foreign Application Priority Data

Dec. 28, 1993 [JP] Japan ..... 5-335004
Dec. 28, 1993 [JP] Japan ..... 5-338674

[51] Int. Cl.[6] ..... G03G 15/08; G03G 15/06

[52] U.S. Cl. ..... 355/259; 118/653

[58] Field of Search ..... 355/259, 245, 355/251, 253; 118/661, 653, 656, 657

[56] References Cited

U.S. PATENT DOCUMENTS

| | | | |
|---|---|---|---|
| 4,370,049 | 1/1983 | Kuge et al. | 355/251 |
| 4,378,158 | 3/1983 | Kanbe | 355/259 |
| 4,385,829 | 5/1983 | Nakahata et al. | 355/253 |
| 4,480,911 | 11/1984 | Itaya et al. | 355/251 |
| 4,669,852 | 6/1987 | Tajima et al. | 118/653 X |
| 4,786,936 | 11/1988 | Ikegawa et al. | 118/657 X |
| 4,836,135 | 6/1989 | Kohyama et al. . | |
| 4,982,689 | 1/1991 | Honda et al. . | |
| 5,412,456 | 5/1995 | Tanuma et al. | 355/245 |
| 5,486,909 | 1/1996 | Takenaka et al. . | |

FOREIGN PATENT DOCUMENTS

| | | | |
|---|---|---|---|
| 0572997A2 | 12/1983 | European Pat. Off. . | |
| 4342060A1 | 6/1994 | Germany . | |
| 56-40861 | 4/1981 | Japan . | |
| 56-40862 | 4/1981 | Japan | 355/259 |
| 58-70256 | 4/1983 | Japan | 355/259 |
| 58-90665 | 5/1983 | Japan . | |
| 59-172669 | 9/1984 | Japan | 355/259 |
| 61-100775 | 5/1985 | Japan | 355/259 |
| 61-34557 | 2/1986 | Japan . | |
| 1-94360 | 4/1989 | Japan . | |
| 1-152480 | 6/1989 | Japan . | |
| 2-103068 | 4/1990 | Japan . | |
| 3-148676 | 6/1991 | Japan . | |
| 4-70876 | 3/1992 | Japan . | |
| 4-84179 | 3/1992 | Japan . | |
| 4-246676 | 9/1992 | Japan . | |
| 5-6089 | 1/1993 | Japan . | |
| 6-175477 | 6/1994 | Japan . | |

*Primary Examiner*—Matthew S. Smith
*Attorney, Agent, or Firm*—Oblon, Spivak, McClelland, Maier & Neustadt, P.C.

[57] ABSTRACT

A developing device for an image forming apparatus and using a single component type developer, i.e., toner, has a developing roller, a doctor blade, and an elastic intermediae roller. The developing roller and intermediate roller contact each other and rotate in the same directions such that they move in opposite directions at the position where they contact each other. The developing roller is provide with a surface roughness of Rz 10 μm or less in terms of ten-point mean value as prescribed by JIS (Japanese Industrial Standards) in order to deposit an adequate charge on toner.

17 Claims, 6 Drawing Sheets

DEVELOPING DEVICE FOR AN IMAGE FORMING APPARATUS

BACKGROUND OF THE INVENTION

The present invention relates to an electrophotographic copier, facsimile apparatus, laser printer or similar image forming apparatus and, more particularly, to a developing device included in such an apparatus for developing a latent image electrostatically formed on a photoconductive element, or image carrier, by toner.

Today, it is a common practice with an electrophotographic image forming apparatus to use an image carrier implemented as a photoconductive belt. The belt is held in contact with a developing roller which is included in a developing device and plays the role of a developer carrier. This kind of arrangement is advantageous in that the wear of the belt is relatively slow due to the elasticity of the belt. However, the belt is problematic from the cost and conveyability aspect. This problem cannot be eliminated without further increasing the cost. For a miniature and inexpensive apparatus, a photoconductive element in the form of a drum is advantageous over the photoconductive belt. However, a photoconductive drum is not durable since a photoconductive layer formed thereon noticeably wears due to friction between it and a developing roller.

A single component type toner, i.e., toner promotes the decrease in the size of the developing device and basically eliminates the need for maintenance, as well known in the art. However, the problem with this kind of developer or toner is that the reliability achievable therewith is poor, and that it cannot be uniformly charged with ease and eventually contains grains charged to the opposite polarity. Toner charged to the opposite polarity contaminates the background of a toner image. The prerequisite with the developing roller, or developer carrier, is that uniformly charged toner forms a layer thereon. Should the amount of toner on the developing roller be excessive, non-charged toner occurs and turns out oppositely charged toner. Further, when the ratio of the linear velocity of the developing roller to that of the photoconductive element is increased, it is likely that a scavenging force acting on the toner becomes excessive for the velocity difference or that the photoconductive element and toner rub against each other, resulting in undesirable charging. In the case where toner is charged by friction between a toner regulating member and the developing roller or by charge injection, the amount of toner which can be uniformly charged, i.e., the amount of toner to deposit on the developing roller for a unit area is limited. Amounts of toner exceeding this limit would increase the ratio of oppositely charged toner. Therefore, it is not always practicable to deposit the same amount of toner on the developing roller as required on the photoconductive element. At the present stage of development, a required amount of toner is not attainable unless the amount of toner on the developing roller and the linear velocity ratio of the developing roller to the photoconductive element are suitably increased., i.e., the amount of toner on the developing roller and the linear velocity ratio are well balanced. Even this kind of approach, however, cannot produce desirable images at all times.

SUMMARY OF THE INVENTION

It is, therefore, an object of the present invention to provide a developing device for an image forming apparatus of the type using a photoconductive drum, and having a developing roller contacting the photoconductive drum and capable of reducing the size and cost of the apparatus.

It is another object of the present inventin to provide a developing device for an image forming apparatus which deposits an adequate amount of charge on toner and thereby reduces non-charged toner so as to protect background from contaimination and prevent image density from lowering.

It is still another object of the present invention to provide a developing device for an image forming apparatus which can form a desirable toner image by eliminating background contamintion and other troubles attributable to oppositely charged toner.

It is a further object of the present invention to provide a developing device for an image forming appratus which prevents toner from falling.

In accordance with the present invention, a developing device for an image forming apparatus and for developing a latent image electrostatically formed on an image carrier by a single component type developer consisting only of toner has a first toner conveying member having a magnetized surface for depositing the toner, a toner regulating member for leveling the toner deposited on the first toner conveying member to thereby form a uniform toner layer, and a second toner conveying member having an elastic surface and for receiving the toner from the first toner conveying member to thereby form a toner layer on the elastic surface and then transferring the toner to the latent image formed on the image carrier.

Also, in accordance with the present invention, a developing device for an image forming apparatus and for developing a latent image electrostatically formed on an image carrier by a single component type developer consisting only of toner has a first toner conveying member, a toner regulating member for leveling the toner deposited on the first toner conveying member, and a second toner conveying member rotated in the same direction as the first toner conveying member so as to move in an opposite direction to the first toner conveying member at a position where the former contacts the latter, for transferring the toner regulated by the toner regulating member to the image carrier at the above-mentioned position to thereby develop the latent image.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
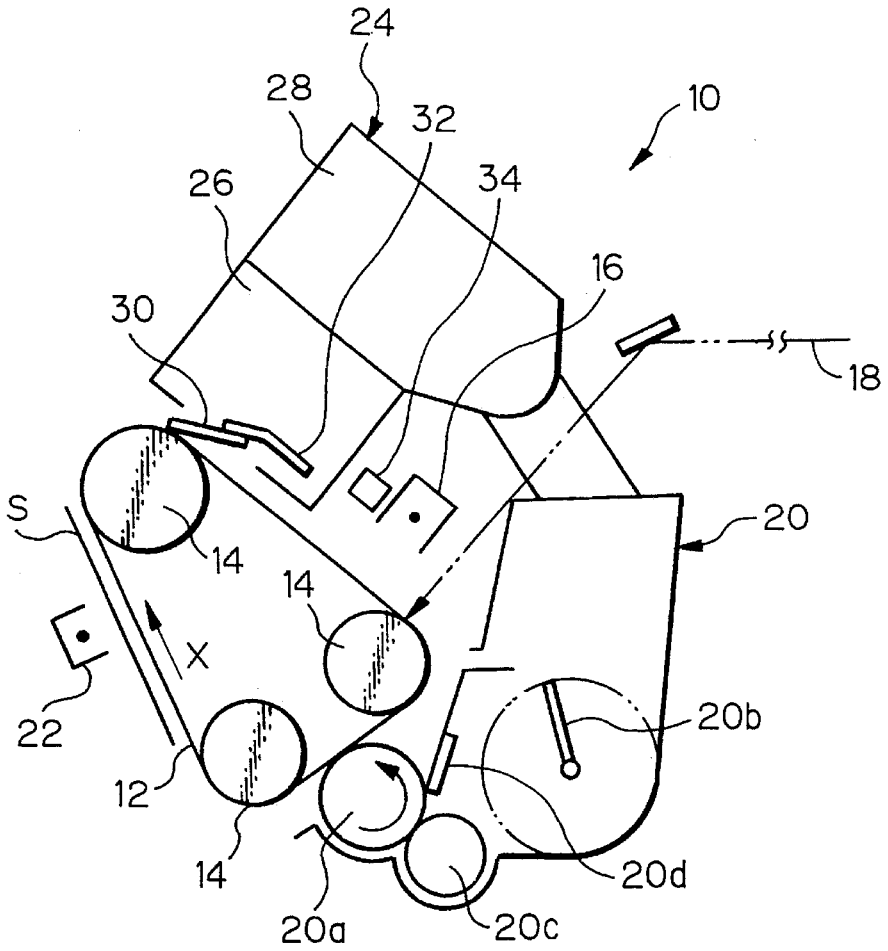
Fig. 1 PRIOR ART
FIG. 1 is a sectional side elevation of an image forming apparatus incorporating a conventional developing device.
Figure 2:
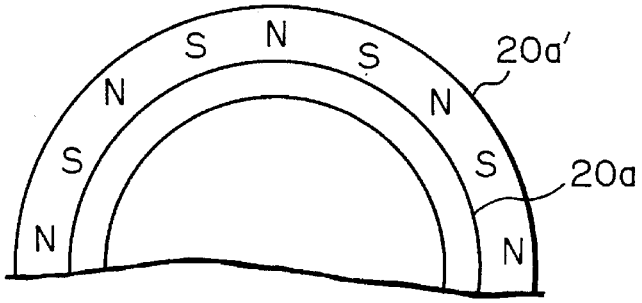
Fig. 2 PRIOR ART
FIG. 2 shows a developing roller included in the conventional developing device and having a magnetized surface.

To better understand the present invention, a brief reference will be made to a conventional developing device included in an electrophotographic copier or similar image forming apparatus. FIG. 1 shows an image forming, apparatus 10 having a photoconductive element 12 implemented as a belt 12. The belt 12 is passed over rollers 14 and movable in a direction indicated by an arrow X in the figure. A charger 16 uniformly charges the surface of the belt 12 to a predetermined polarity. An optical writing unit 18 electrostatically forms a latent image on the charged surface of the belt 12 by exposing it. A developing device 20 has a developing roller 20*a* for depositing a single component type developer, i.e., magnetic toner on the latent image to produce a corresponding toner image, an agitator 20*b* for agitating the toner, a supply roller 20*c* for supplying the toner to the developing roller 20*a*, and a metallic doctor blade 20*d* pressed against the developing roller 20*a* by a predetermined pressure. A transfer charger 22 transfers the toner image from the belt 12 to a sheet S. A cleaner/toner magazine (CTM) 24 is removably mounted on the body of the apparatus and made up of a tank portion 26 for collecting waste toner and a tank portion 28 for replenishing fresh toner. A cleaning blade 30 is affixed to a holder 32 which is disposed in the waste toner tank portion 26. The cleaning blade 30 scrapes off toner remaining on the belt 12 after image tranfer and collects it in the tank portion 26. A discharge lamp 34 dissipates charges also remaining on the belt 12 after image transfer, thereby restoring the belt 12 to the initial state. The sheet S carrying the toner image thereon is driven out of the apparatus by way of a fixing device, not shown. When the toner in the developing device 20 runs short, fresh toner is replenished from the fresh toner tank portion 28 into the device 20. The developing roller 20*a* is made of resin containing a magntic substance. As shown in FIG. 2, a plurality of magnetic poles are arranged on the surface 20*a'* of the roller 20*a*.

Generally, the latent image formed on the belt 12 is developed by the following procedure. First, the agitator 20*b* and supply roller 20*c* are rotated to convey the magnetic toner to just below the developing roller 20*a*. The toner is deposited on the magnetized surface 20*a'* of the developing roller 20*a*. While the developing roller 20*a* is rotated to convey the toner, the doctor blade 20*d* levels the toner to form a thin toner layer while charging it by friction. At the position where the developing roller 20*a* contacts the belt 12, the toner is selectively tranferred from the roller 20*a* to the belt 12 to thereby develop the latent image.

In the apparatus 10 having the photocoductive belt 12, the belt 12 and developing roller 20*a* are held in contact with each other for developing a latent image. This kind of arrangement is advantageous in that the wear of the belt 12 is relatively slow due to the elasticity of the belt 12. However, the belt 12 is problematic in the cost and conveyability aspect. This .problem cannot be eliminated without further increasing the cost. For a miniature and inexpensive apparatus, a photoconductive element in the form of a drum is advantageous over the photoconductive belt. However, a photoconductive drum is not durable since a photoconductive layer formed thereon noticeably wears due to friction between it and a developing roller.

Figure 3:
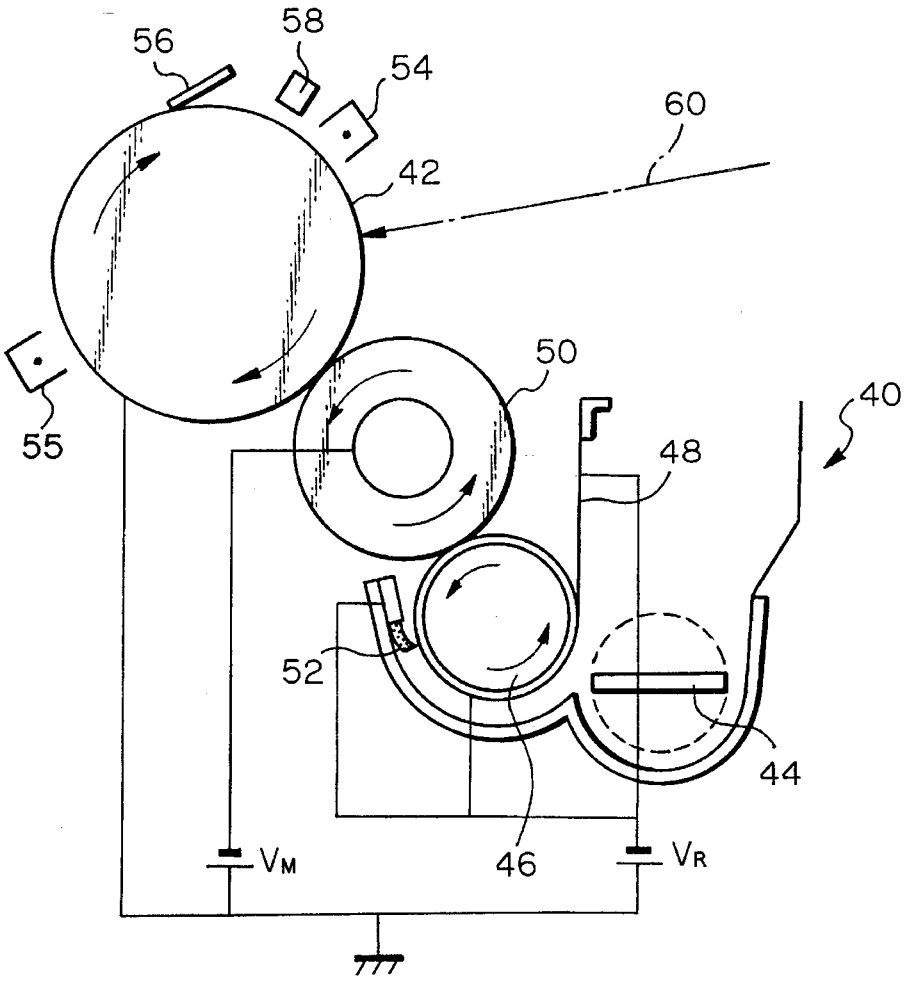
FIG. 3 is a fragmentary sectional side elevation of an image forming apparatus having a developing device embodying the present invention.
Figure 4:
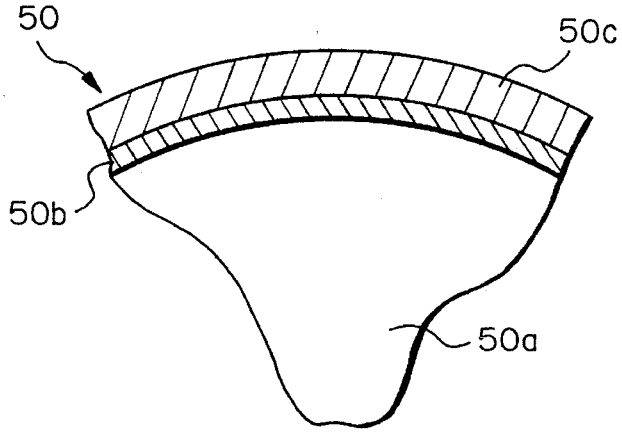
FIG. 4 is a setion of an intermediate roller included in the embodiment.

Referring to FIG. 3, an image forming apparatus having a developing device embodying the present invention will be described. As shown, the apparatus has a photoconductive drum 42 made of a hard material, an agitator 44, a developing roller 46 made of a hard material and serving as first toner conveying means, a doctor blade or toner regularting member 48, an intermediate roller or second toner conveying means 50 made of an elastic material, a discharge brush 52, a main charger 54, a transfer charger 55, a cleaning blade 56, a discharger 58, and an optical writing unit 60. The agitator 44, developing roller 46, doctor blade 48, intermediate roller 50 and discharge brush 52 constitute a developing device 40. The doctor blade 48 and discharge brush 52 are held in contact with the developing roller 46. The intermediate roller 50 is held in contact with the developing roller 46 and drum 42. A bias $V_R$ is applied to the developing roller 46, doctor blade 48 and discharge brush 52 while a bias $V_M$ is applied to the intermediate roller 50. The drum 42 is connected to ground. The biases $V_R$ and $V_M$ have a relation of $0>V_M>V_R$. As shown in FIG. 4, the intermediate roller 50 has a core 50*a* made of conductive rubber, an electrode layer 50*b* formed on the core 50*a*, and a coating layer 50*c* formed on the electrode layer 50*b*. The coating layer 50*c* is made of an insulating, or non-conductive material e.g. fluorin-contained resin.

In operation, the developing roller 46 and intermediate roller 50 are rotated counterclockwise as viewed in FIG. 3, while the drum 42 is rotated clockwise. First, the agitator 44 in rotation conveys toner to just below the developing roller 46. Since the toner is not accompanied by carrier and contains magnetic powder, it is deposited on the magnetized surface of the roller 46 and conveyed by the roller 46. The doctor blade 48 levels the toner on the roller 46 to form a thin toner layer while charging it to negative polarity by friction. Since the surface potential of the intermediate roller 50 is higher than that of the developing roller 46, the toner deposited on the developing roller 46 and negatively charged is tranferred from the roller 46 to the roller 50 at the position where the rollers 46 and 50 contact each other. Further, the surface portion of the drum 42 charged by the main charger 54 is lower in potential than the surface of the intermediate roller 50, and the latent image formed on the drum 42 by the writing unit 60 is higher in potential than the surface of the roller 50. As a result, the toner is selectively transferred from the intermediate roller 50 to the latent image thereby forming a toner image on the drum 42. Subsequently, the toner image is transferred from the drum 42 to a sheet by the tranfer charger 55 and then fixed on the sheet by heat. Finally, the sheet carrying the toner image thereon is driven out of the apparatus.

Figure 5:
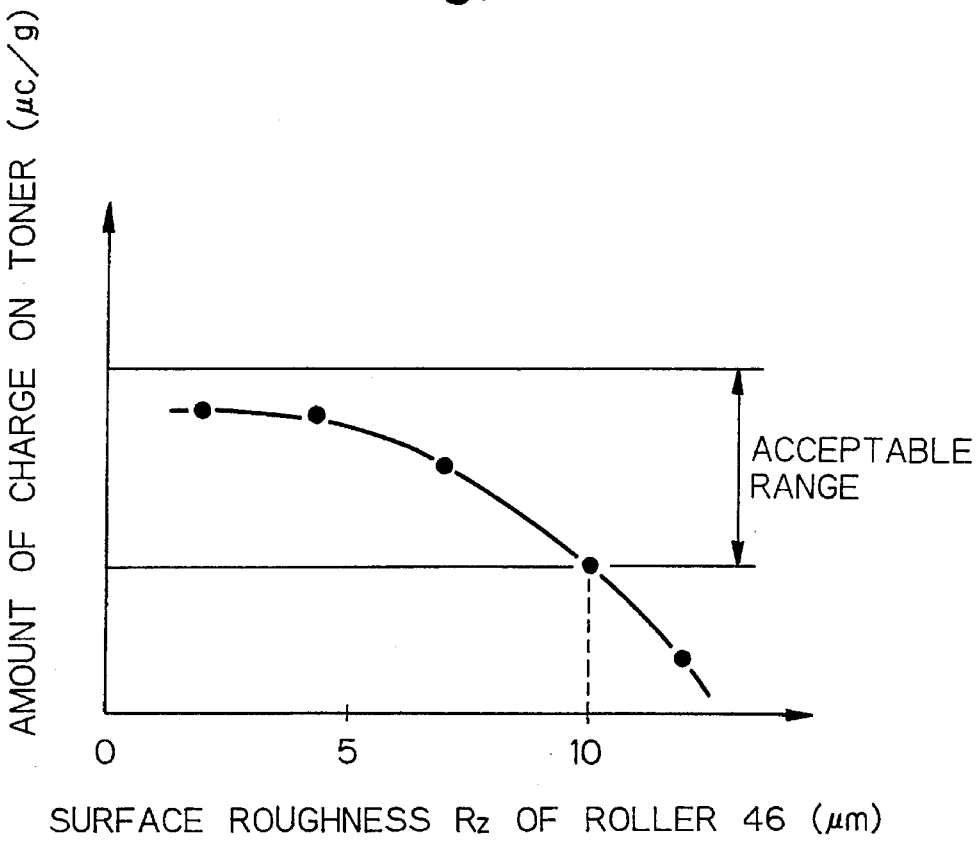
FIG. 5 is a graph indicating a relation between the surface roughness of a developing roller also included in the embodiment and the amount of charge to deposit on toner.

FIG. 5 shows a relation between the surface roughness of the developing roller 46 and the amount of charge to deposit on the toner. In the illustrative embodiment, the toner is charged by the friction between the developing roller 46 and the doctor blade 48. Therefore, as FIG. 5 indicates, the frictional charging of toner greatly depends on the surface roughness of the developing roller 46. Short charges on toner would contaminate the background of a toner image while excessive charges would lower image density due to short development. The embodiment deposits an adequate amount of charge on toner by providing the developing roller 46 with a surface roughness of Rz 10 μm or less in terms of ten-point mean value as prescribed by JIS (Japanese Industrial Standards).

Figure 6:
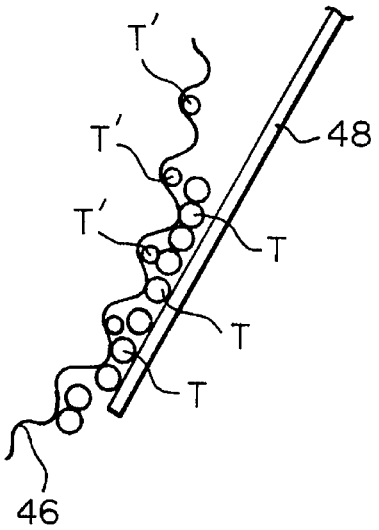
FIG. 6 illustrates how defective charging occurs when the surface roughness of the developing roller is greater than the volume or the mean grain size of toner.

On the other hand, assume that the surface roughness of the developing roller 46 is greater than the volume or the mean grain size of toner for a number. Then, as shown in FIG. 6, non-charged toner grains T' appear between the doctor blade 48 and the developing roller 46. Specifically, such grains T' penetrate into recesses existing on the surface of the developing roller 46 and do not contact the doctor blade 48 The non-charged grains T' contaminate the background of a toner image. The embodiment obviates the short charging of toner by providing the developing roller 46 with a surface roughness smaller than the mean grain size of toner. In FIG. 6, toner grains having the mean grain size are labeled T.

Figure 7:
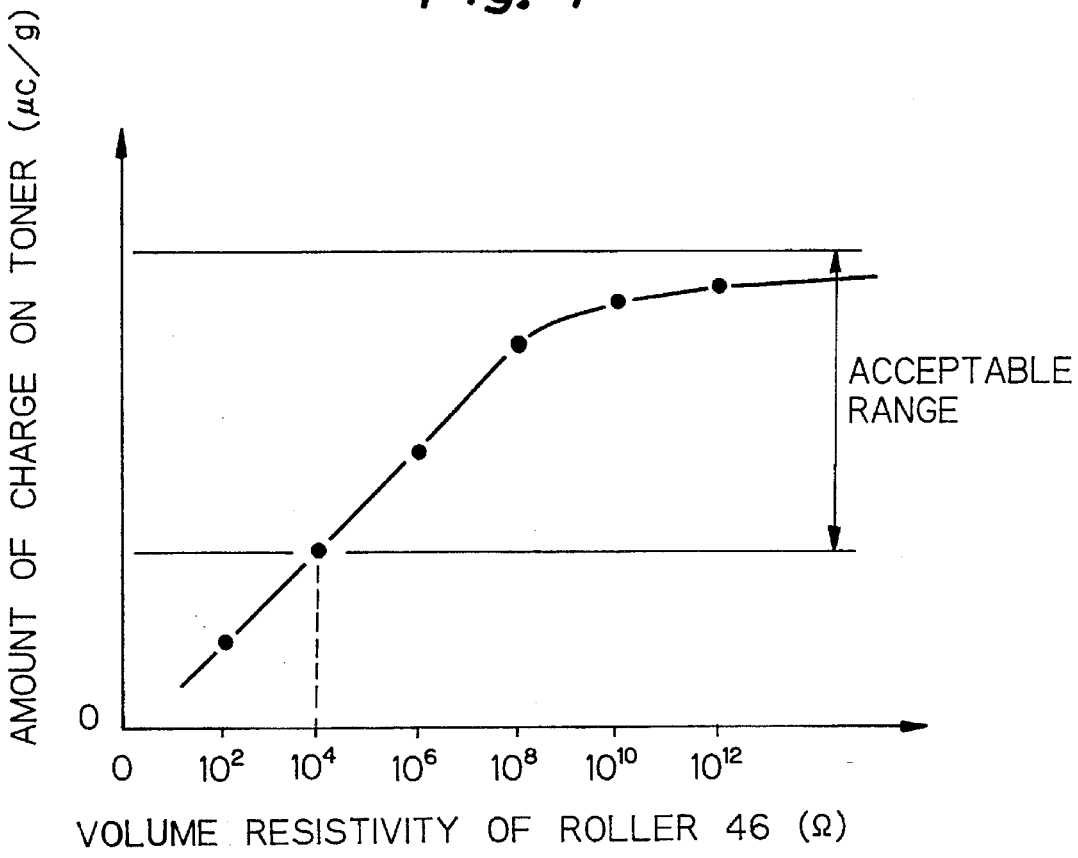
FIG. 7 is a graph showing a relation between the specific volume resistivity of the developing roller and the amount of charge to deposit on toner.

The specific volume resistivity of the developing roller 46 and the amount of charge to deposit on toner are correlated, as shown in FIG. 7. When the resistance of the developing roller 46 is low, toner deposited on the surface of the roller 46 moves easily and thereby lowers the amount of charge. The embodiment prevents the amount of charge from decreasing by providing the roller 46 with a specific volume resistivity of $10^4$ Ωcm or above.

The embodiment shown and described has various unprecedented advantages as enumerated below.

(1) Since the intermediate roller 50 is elastic, the developing roller 46 and intermediate roller 50 and the intermediate roller 50 and drum 42 contact each other softly. This successfully reduces the damage to the photoconductive layer of the drum 42 and, therefore, realizes a miniature and inexpensive image forming apparatus using a photoconductive drum and single component type developer, i.e., toner.

(2) The developing roller 46 is provided with a surface roughness of Rz 10 μm or less in terms of JIS ten-point mean value, so that an adequate amount of charge is deposited on toner. The adequate amount of charge prevents the background of an image from being contaminated and prevents the image density from being lowered.

(3) The surface roughness of the developing roller 46 is selected to be smaller than the mean grain size of toner in order to reduce non-charged grains as far as possible. This reduces defective images including an image with contaminated background.

(4) The developing roller 46 is provided with a specific volume resistivity of $10^4$ Ωcm or above. As a result, an adequate amount of toner is deposited on toner so as to eliminate defective images attributable to short charging.

An alternative embodiment of the present invention will be described which obviates, for example, background contamination attributable to toner grains charged to the oppsite polarity.

Figure 8:
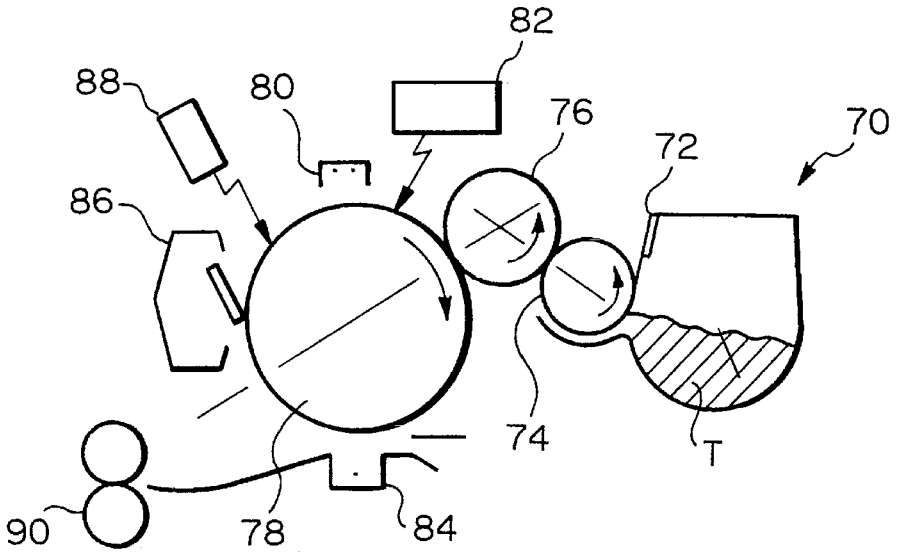
FIG. 8 is a fragmentary sectional side elevation of an image forming appaatus implemented with an alternative embodiment of the present invention.

FIG. 8 shows an image forming apparatus having a developing device 70 which stores toner T. As shown, the developing device 70 has a developing blade or toner regulating means 72, a developing roller or first toner conveying means 74, and an intermediate roller or second toner conveying means 76 contacting the roller 74. The blade 72 levels toner deposited on the developing roller 74 while charging it by friction between it and the roller 74. The charged toner is transferred from the developing roller 74 to the intermediate roller 76 by the force of an electric field. Further, the toner is tranferred from the intermediate roller 76 to a photoconductive drum, or image carrier, 78 so as to develop a latent image electrostatically formed on the drum 78. Arranged around the drum are a main charger 80, laser optics 82 for writing an image on the drum 78, a transfer charger 84, a cleaning unit 86, a discharger 88 and other conventional units for image formation. The reference numeral 90 designates a fixing unit for fixing a toner image on a sheet.

Figure 9:
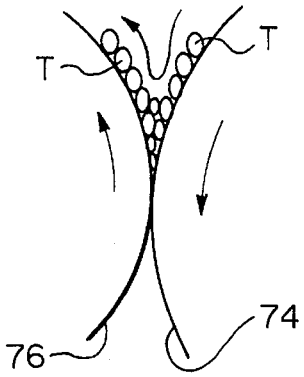
FIG. 9 demonstrates the movement of toner at a position where a developing roller and an intermediate roller of the alternative embodiment contact each other.
Figure 10:
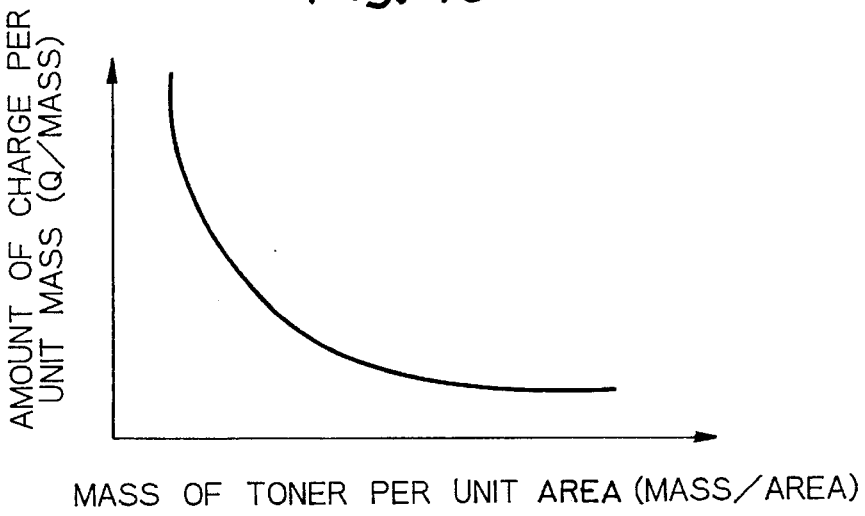
FIG. 10 is a graph indicating a relation between the amount of toner for a unit area and the amount of charge of toner.

When the charged toner T is tranferred from the developing roller 74 to the intermediate roller 76, the rollers 74 and 76 are moved in opposite directions, as viewed at the position where they contact each other. Hence, as shown in FIG. 9, the rollers 74 and 76 rub against each other at the contact position with the result that the roller 76 scrape off the toner from the roller 74. In this manner, the toner transfer from the roller 74 to the roller 76 is effected not only by the force of the electric field but also by a mechanical force. Consequently, the toner transfer ratio from the roller 74 to the roller 76 increases and readily implements the required amount of toner on the roller 76. This allows the amount of toner on the roller 74 to be reduced or allows the linear velocity of the roller 74 to be reduced in order to set up a desirable ratio in linear velocity of the roller 74 to the roller 76. FIG. 10 shows a relation between the amount of toner and the amount of charge to deposit thereon. As shown, the amount of charge increases as the amount of toner for a unit area decreases. Therefore, by reducing the amount of toner on the roller 74, it is possible to increase the amount of charge to deposit on toner and thereby obviate short charging and non-charged toner grains. Assuming a line connecting the axes of the rollers 74 and 76, only the toner T at one side is conveyed. It follows that the toner T is prevented from falling if it is conveyed at the upper side with respect to the vertical direction.

Figure 11:
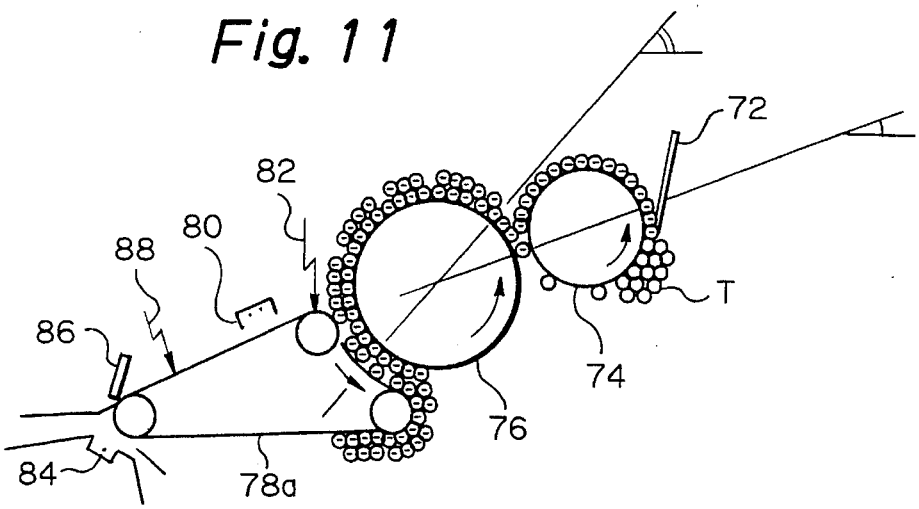
FIG. 11 shows the movement of non-magnetic toner to occur when an image carrier is implemented by a photoconductive belt.
Figure 12:
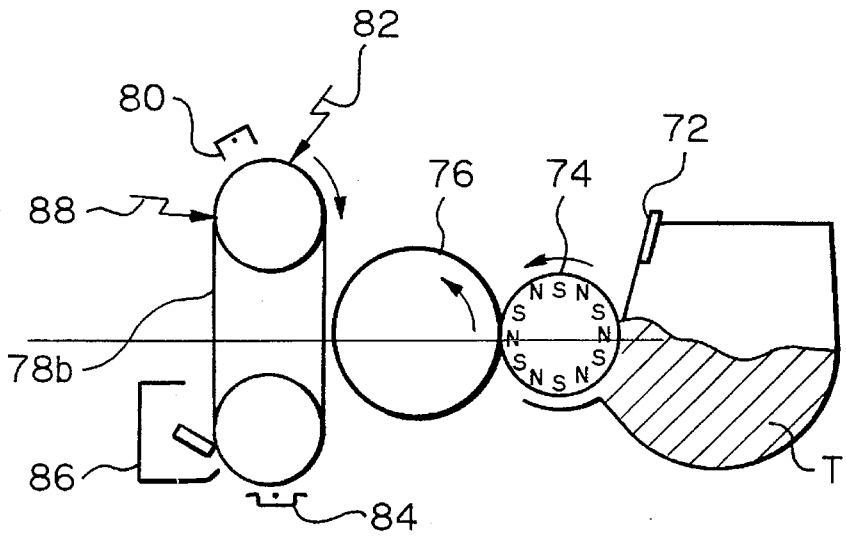
FIG. 12 is a sectional side elevation of an arrangement using magnetic toner and a photoconductive belt supported at two points.
Figure 13:
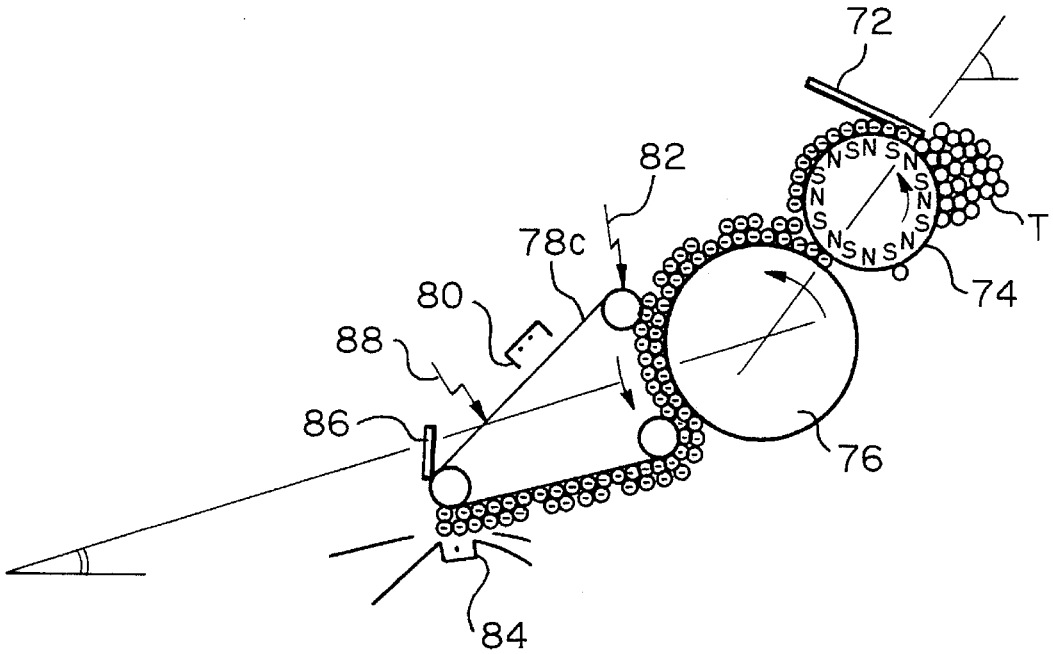
FIG. 13 is a view similar to FIG. 13, showing an arrangement using a magnetic toner and photoconductive belt supported at three points.

FIG. 11 illustrates how non-magnetic toner T moves when the image carrier is implemented as a photoconductive belt 78*a*. FIG. 12 shows an arrangement operable with magnet toner T and a photoconductive belt 78*b* which is supported at two points. Further, FIG. 13 shows an arrangement using magnetic toner T and a photoconductive belt 78*c* supported at three points.

In summary, the alternative embodiment of the present invention has the following advantages.

(1) After toner has been leveled on the first toner conveying means 74 by the toner regulating member 72, it is transferred from the conveying means 74 to the second toner conveying means 76 and then to the photoconductive element 78. This successfully prevents the background of a toner image from being contaminated by toner charged to the opposite polarity.

(2) The first and second toner conveying means 74 and 76 move in opposite directions to each other at the position where they contact each other. Hence, the toner transfer from the conveying means 74 to the conveying means 76 is effected not only by the force of an electric field but also by a mechanical force. As a result, the toner transfer ratio from the conveying means 74 to the conveying means 76 increases and readily implements a required amount of toner on the conveying means 76. This allows the amount of toner on the conveying means 74 to be reduced or the linear velocity of the conveying means 74 to be reduced.

(3) Assuming a line connecting the axes of the first and second conveying means 74 and 76, only the toner at one side is conveyed. Hence, toner is prevented from falling if it is conveyed at the upper side with respect to the vertical direction.

Various modifications will become possible for those skilled in the art after receiving the teachings of the present disclosure without departing from the scope thereof.

What is claimed is:

1. A developing device for an image forming apparatus and for developing a latent image electrostatically formed on an image carrier by a single component type developer consisting only of toner, said device comprising:

first toner conveying means having a magnetized surface for depositing the toner;

toner regulating means for leveling the toner deposited on said first toner conveying means to thereby form a uniform toner layer; and second toner conveying means for receiving the toner from said first toner conveying means to thereby form a toner layer on said second toner conveying means and then transferring said toner to the latent image formed on the image carrier, said second toner conveying means comprising an elastic surface, an electrode layer disposed on said elastic surface, and a non-conductive layer disposed on said electrode layer.

2. A device as claimed in claim 1, wherein said first toner conveying means has a surface roughness of Rz 10 μm or less in terms of JIS ten-point mean value.

3. A device as claimed in claim 1, wherein said first toner conveying means has a surface roughness smaller than a mean grain size of the toner.

4. A device as claimed in claim 1, wherein said first toner conveying means has a specific volume resistance of $10^4$ Ωcm or above.

5. A device as claimed in claim 1, wherein said second toner conveying means contacts said first toner conveying means and the image carrier.

6. A device as claimed in claim 1, wherein the image carrier comprises a photoconductive drum, said second toner converying means comprising an intermediate roller contacting said photoconductive drum, said first toner conveying means comprising a developing roller contacting said intermediate roller.

7. A device as claimed in claim 6, wherein said developing roller and said intermediate roller in a same direction so as to move in opposite directions to other at a position where said developing roller and said intermediate roller contact each other.

8. A developing device as claimed in claim 1, further including means for applying a first bias voltage to said first toner conveying means and means for applying a second bias voltage to said second toner conveying means, and wherein said first bias voltage is not equal to said second bias voltage.

9. A developing device as claimed in claim 8, wherein said second bias voltage is smaller than said first bias voltage.

10. A developing device as claimed in claim 9, further including means for applying said first bias voltage to said toner regulating means.

11. A developing device as claimed in claim 8, further including means for applying said first bias voltage to said toner regulating means.

12. A developing device as claimed in claim 1, wherein said second toner conveying means comprises a roller having a rubber core, said rubber core providing said elastic surface.

13. A developing device as claimed in claim 1, further including means for applying a bias voltage to said first toner conveying means and to said toner regulating means.

14. A developing device for an image forming apparatus and for developing a latent image electrostatically formed on an image carrier by a single component type developer consisting only of toner, said device comprising:

first toner conveying means;

toner regulating means for leveling the toner deposited on said first toner conveying means; and second toner conveying means rotated in a same direction as said first toner conveying means so as to move in an opposite direction to said first toner conveying means at a position where said second toner conveying means contacts said first toner conveying means, for transferring the toner regulated by said toner regulating means to the image carrier at said position to thereby develop the latent image;

wherein said first and second toner conveying means respectively comprise first and second rollers, and wherein with respect to a line extending through axes of said first and second rollers, said toner regulating means is disposed adjacent to said first roller within a region through which said line extends such that toner is leveled and conveyed on each of said first and second rollers on one side of said line.

15. A device as claimed in claim 14, wherein said second toner conveying means contacts the image carrier.

16. A device as claimed in claim 14, wherein the image carrier comprises a photoconductive drum, said second toner conveying means comprising an intermediate roller contacting said photoconductive drum, said first toner conveying means comprising a developing roller contacting said intermediate roller.

17. A developing device as claimed in claim 14, wherein said toner regulating means frictionally charges the toner.

* * * * *